US005935421A

United States Patent [19]

Brons et al.

[11] Patent Number: 5,935,421

[45] Date of Patent: Aug. 10, 1999

[54] CONTINUOUS IN-SITU COMBINATION PROCESS FOR UPGRADING HEAVY OIL

[75] Inventors: Glen Brons, Phillipsburg, N.J.; Ronald D. Myers, Calgary, Canada; Roby Bearden, Baton Rouge, La.

[73] Assignee: Exxon Research and Engineering Company, Florham Park, N.J.

[21] Appl. No.: 08/734,322

[22] Filed: Oct. 21, 1996

Related U.S. Application Data

[63] Continuation-in-part of application No. 08/433,906, May 2, 1995, abandoned.

[51] Int. Cl.[6] ..... C10G 19/02

[52] U.S. Cl. ..... 208/226; 208/227; 208/230

[58] Field of Search ..... 208/226–9, 40, 208/230

[56] References Cited

U.S. PATENT DOCUMENTS

| | | | |
|---|---|---|---|
| 2,772,211 | 11/1956 | Hawkes et al. | 208/208 M |
| 2,950,245 | 8/1960 | Thomsen | 208/230 |
| 3,164,545 | 1/1965 | Mattox | 208/230 |
| 3,185,641 | 5/1965 | Cowden | 208/226 |
| 3,449,242 | 6/1969 | Mattox et al. | 208/230 |
| 3,785,965 | 1/1974 | Welty | 208/230 |
| 3,787,315 | 1/1974 | Bearden, Jr. et al. | 208/230 |
| 3,788,978 | 1/1974 | Bearden, Jr. et al. | 208/230 |
| 3,791,966 | 2/1974 | Bearden, Jr. | 208/230 |
| 4,003,823 | 1/1977 | Baird, Jr. et al. | 208/230 |
| 4,003,824 | 1/1977 | Baird, Jr. et al. | 208/230 |
| 4,007,109 | 2/1977 | Baird et al. | 208/100 |
| 4,007,110 | 2/1977 | Bearden, Jr. | 208/110 |
| 4,076,613 | 2/1978 | Bearden, Jr. | 208/108 |
| 4,127,470 | 11/1978 | Baird, Jr. et al. | 208/58 |
| 4,163,043 | 7/1979 | Dezael et al. | 423/234 |
| 4,310,049 | 1/1982 | Kalvinskas et al. | 208/225 |
| 4,343,323 | 8/1982 | Kessick et al. | 137/13 |
| 4,437,980 | 3/1984 | Heredy et al. | 208/225 |
| 4,566,965 | 1/1986 | Olmstead | 230/208 M |
| 4,927,524 | 5/1990 | Rodriguez et al. | 208/11 |
| 5,160,045 | 11/1992 | Falkiner et al. | 210/634 |

OTHER PUBLICATIONS

Adzhiev et al., *Neft. Khoz.*, 1986, (10), 53–57.

Shul'ga et al., Tr. Grozen. *Neft. Nauch.*, 1972, (25), 19–26.

Burger et al., "Symposium on Progress in Processing Synthetic Crudes and Resids," ACS (Aug. 24–29, 1975).

Yamaguchi et al., "Desulfurization of Heavy Oil and Preparation of Activated Carbon by Means of Coking Procedure," Chibakogyodaiku Kenkyui Hokoku No. 21, p. 115 (Jan. 30, 1976).

LaCount et al., "Oxidation of Dibenzothiophene and Reaction of Dibenzothiophene 5,5–Dioxide with Aqueous Alkali," Journal of Organic Chemistry, 42 (16), 1977.

*Primary Examiner*—Helane Myers
*Attorney, Agent, or Firm*—Linda M. Scuorzo

[57] ABSTRACT

The invention relates to an integrated, continuous process for the removal of organically bound sulfur (e.g., mercaptans, sulfides and thiophenes) comprising the steps of contacting a heavy oil, sodium hydroxide, hydrogen and water at a temperature of from about 380° C. to 450° C. to partially desulfurize the heavy oil and to form sodium sulfide, contacting said sodium sulfide via steam stripping to convert the sodium sulfide to sodium hydroxide and the sulfur recovered as hydrogen sulfide. The sodium hydroxide is recirculated for reuse. The partially desulfurized, dewatered heavy oil is treated with sodium metal under desulfurizing conditions, typically at a temperature of from about 340° C. to about 450° C., under a hydrogen pressure of at least about 50 psi to essentially desulfurize the oil, and form sodium sulfide. Optionally, the sodium salt generated can be regenerated to sodium metal using regeneration technology. The process advantageously produces essentially sulfur-free product oils having reduced nitrogen, oxygen and metals contents and reduced viscosity, density, molecular weight and heavy ends.

7 Claims, 3 Drawing Sheets

CONTINUOUS IN-SITU COMBINATION PROCESS FOR UPGRADING HEAVY OIL

This application is a continuation-in-part of U.S. Ser. No. 433,906 filed May 2, 1995, which is based on P.M. 94CL001, 94CL002 and 94BR003 ABANDONED.

FIELD OF THE INVENTION

The present invention relates to a process for desulfurizing heavy oils.

BACKGROUND OF THE INVENTION

The quality of residue feeds, particularly bitumen (heavy oil), suffers from high levels of heteroatoms (sulfur, nitrogen and oxygen) and metals (nickel, vanadium and iron). Refining and/or conversion of such sulfur-laden crudes is costly due to the hydrogen needed to remove the sulfur. As environmental pressures continue to lower allowable emission levels in mogas and diesel products, refining costs continue to rise.

Penalty costs for sulfur-laden feeds in refineries can be exorbitant. Hence, deep desulfurization of such feeds has become a critical research target. Thus, there is a need for low cost processes which upgrade oils to more environmentally friendly and more profitable feedstocks.

Much work has been done utilizing molten caustic to desulfurize heavy oils. For example, see "Molten Hydroxide Coal Desulfurization Using Model Systems," Utz, Friedman and Soboczenski, 51-17 (Fossil Fuels, Derivatives, and Related Products, ACS Symp. Series., 319 (Fossil Fuels Util.), 51–62, 1986 CA105(24):211446Z); "An Overview of the Chemistry of the Molten-caustic Leaching Process," Gala, Hemant, Srivastava, Rhee, Kee, Hucko, and Richard, 51–6 (Fossil Fuels, Derivatives and Related Products), Coal Prep. (Gordon & Breach), 71-1-2, 1–28, 1989 CA112(2): 9527r; and "Base-catalyzed Desulfurization and Heteroatom Elimination from Coal-model Heteroaromatic Compounds," 51-17 (Fossil Fuels, Derivatives, and Related Products, Coal Sci. Technol., 11 (Int. Conf. Coal Sci., 1987), 435–8, CA108 (18):153295y).

Additionally, work has been done utilizing aqueous caustic to desulfurize shale and coal. U.S. Pat. No. 4,437,980 discusses desulfurizing, deasphalting and demetallating shale and coal in the presence of molten potassium hydroxide, hydrogen and water at temperatures of about 350° C. to about 550° C. U.S. Pat. No. 4,566,965 discloses a method for removal of nitrogen and sulfur from oil shale with a basic solution comprised of one or more hydroxides of the alkali metals and alkaline earth metals at temperatures ranging from about 50 to about 350° C.

Methods also exist for the regeneration of aqueous alkali metal, see e.g., U.S. Pat. No. 4,163,043 discussing regeneration of aqueous solutions of Na, K and/or ammonium sulfide by contact with Cu oxide powder yielding precipitated sulfide which is separated and re-oxidized to copper oxide at elevated temperatures and an aqueous solution enriched in NaOH, KOH or $NH_2$. Romanian patent RO-101296-A describes residual sodium sulfide removal wherein the sulfides are recovered by washing first with mineral acids (e.g., hydrochloric or sulfuric acid) and then with sodium hydroxide or carbonate to form sodium sulfide followed by a final purification comprising using iron turnings to give insoluble ferrous sulfide.

Sodium metal desulfurization is also disclosed in U.S. Pat. Nos. 3,785,965, 3,787,315, 3,788,978, 3,791,966, 3,796,559, 4,076,613 and 4,003,824.

U.S. Pat. No. 4,003,823 discloses a process for desulfurizing and hydroconverting heavy feeds by contacting the feed at elevated temperature with alkali metal hydroxides in the molten state. Water is tolerated as an impurity but only up to 15 wt % water based on alkali metal hydroxide, and has a suppressing effect when present in greater than 20%. The (Col. 8, 1. 64–68 etc.) patent teaches the presence of liquid, molten or vapor phases, but expressly teaches away from the operability of a substantially aqueous NaOH.

What is needed is a continuous process for removal of organically bound sulfur which further allows for recovery and regeneration of the desulfurizing agents, and which reduces the amount of sodium metal needed for use in the desulfurizing processes. Processes that reduce the need for sodium metal treatments in the desulfurization process are highly desirable.

SUMMARY OF THE INVENTION

The instant invention is directed toward an integrated, continuous process for the removal of organically bound sulfur existing as mercaptans, sulfides and thiophenes, more preferably thiophenes. The process also results in significant reductions in nitrogen and metals (vanadium, nickel, iron and cobalt), viscosity, density and molecular weight. Other upgrading effects can include reductions in asphaltene content (n-heptane insolubles), micro concarbon residue (MCR), coke, 975° $F.^+$ fractions, TGA fixed carbon, and average molecular weight as determined by vapor pressure osmometry (VPO). Moreover, the process also results in the removal of metals from organically bound metal complexes, e.g., the metalloporphyrins.

One embodiment of the present invention comprises: (a) contacting a heavy oil with a first portion of sodium hydroxide, hydrogen and water at a temperature of from about 380° C. to 450° C. for a time sufficient to produce a partially desulfurized heavy oil, water and sodium sulfide; (b) treating said sodium sulfide of step (a) via steam stripping to convert the sodium sulfide to sodium hydroxide and recovering the sulfur as hydrogen sulfide; (c) recirculating said sodium hydroxide of step (b) to step (a); (d) contacting the partially desulfurized heavy oil of step (a) with sodium metal under desulfurizing conditions, preferably under essentially anhydrous conditions in the essential absence of oxygen at a temperature of from about 340° C. to about 450° C., under a hydrogen pressure of at least about 50 psi (345 kPa) to produce an essentially desulfurized product oil, and form sodium sulfide; (e) optionally, contacting the sodium sulfide of step (d) with hydrogen sulfide to generate sodium hydrosulfide which is separated. A further embodiment comprises: (a) contacting a heavy oil with sodium sulfide and water in-situ to form sodium hydroxide and sodium hydrosulfide at a temperature of from about 380° C. to about 450° C. for a time sufficient to produce a partially desulfurized heavy oil, sodium sulfide and sodium hydrosulfide; (b) removing at least a portion of the sodium salts to generate sodium metal as described in the U.S. patents on sodium metal desulfurization listed above and then contacting the partially desulfurized heavy oil of step (a) with sodium metal under desulfurizing conditions to further desulfurize the oil, preferably under essentially anhydrous conditions in the essential absence of oxygen at a temperature of from 340° C. to about 450° C., under a hydrogen pressure of at least about 50 psi (345 kPa) to produce a desulfurized product oil, and sodium sulfide; (c) recirculating at least a portion of said sodium sulfide of step (b) to step (a) with the addition of water.

Sodium hydroxide is required to be present in aqueous (non molten) form, with water to be at least 30 wt % based on weight of NaOH.

DETAILED DESCRIPTION OF THE INVENTION

Figure 1:
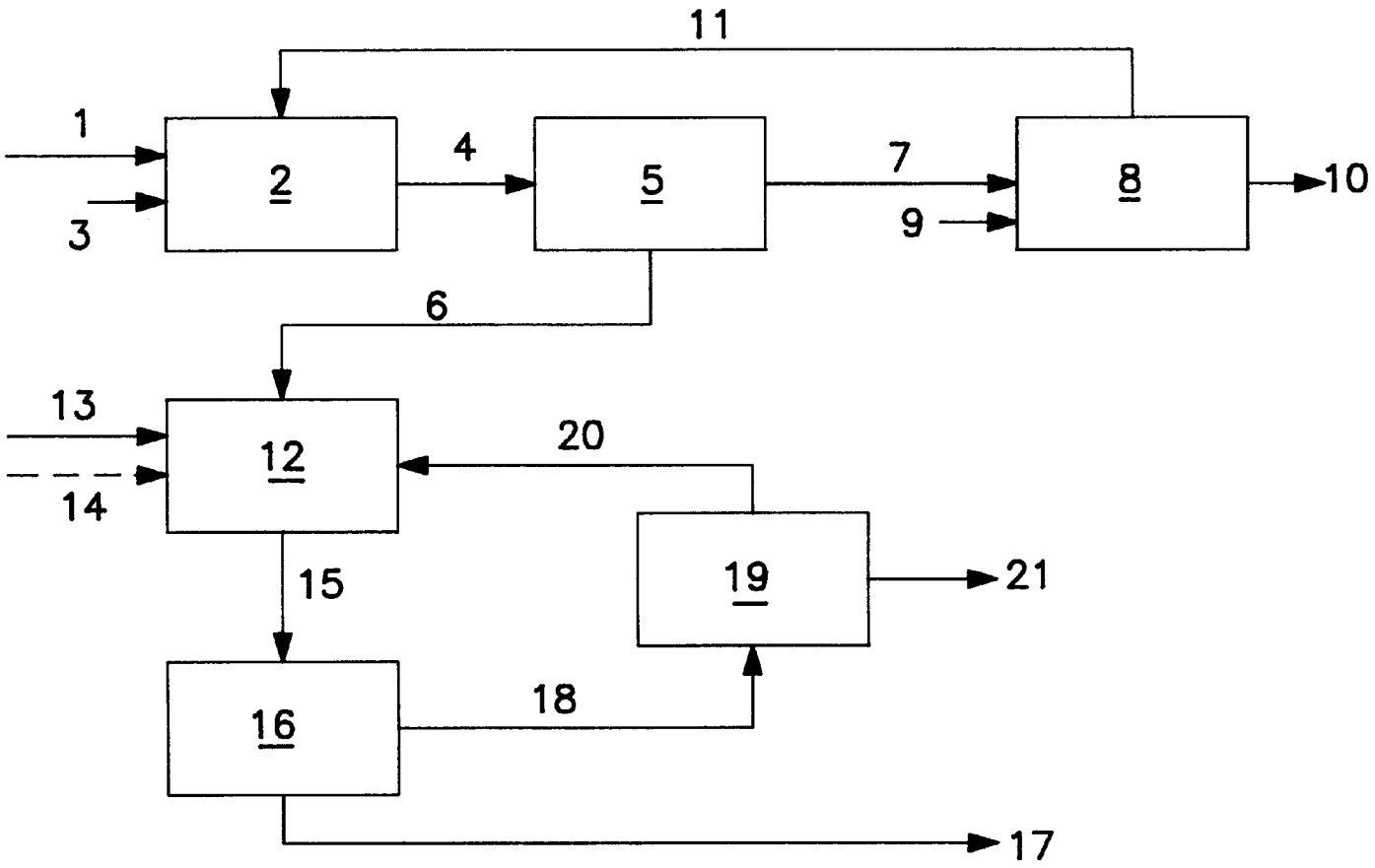
FIG. 1 describes an embodiment of the process using transition metal exchange to regenerate sodium hydroxide from sodium sulfide salts in a combination process using sodium hydroxide as a pretreatment to sodium metal desulfurization of heavy oil feed.

The present invention provides for a combination process in which aqueous base desulfurization is used in an integrated process with sodium metal desulfurization to pretreat or initially partially remove certain organically bound sulfur moieties, metals in the form of iron and organically bound metal complexes of nickel and vanadium and heteroatoms of nitrogen and oxygen, preferably nitrogen from heavy oils (e.g., bitumens and atmospheric and vacuum resid from petroleum, heavy crudes (greater than 50% boiling at 1050° F., and high sulfur crudes (greater than 0.5% sulfur)). The process can provide a benefit of extending the effectiveness of the hydroxide used in the pretreatment step by in-situ regeneration of the hydroxide from sodium sulfide salt products by contacting with steam.

Applicants have found that aqueous hydroxides are capable of removing organically bound sulfur moieties from heavy oils and bitumen and other organic sulfur-containing feedstocks. These moieties are, for example, sulfides and thiophenes.

Applicants believe that the presence of water during desulfurization reduces the amount of heavier materials such as asphaltenes and other coking precursors as measured by Micro Carbon Residue (MCR) by acting as a medium which inhibits undesirable secondary reactions which lead to coke formation (such as addition reactions of radicals formed via thermal cracking, to aromatics forming heavy-end, low value products).

The concentration of aqueous hydroxide added to the organic sulfur containing feedstock will range from about 5 wt % to about 60 wt %, preferably about 20 wt % to about 50 wt % based on the weight of the feedstock. Such concentrations provide a mole ratio of about 2:1 to about 4.5:1 alkali metal hydroxide:sulfur. However, the amount of water combined with the NaOH to form the aqueous hydroxide is critical with at least 30 wt %, preferably at least 40 wt % water based on one amount of alkali metal hydroxide. Ninety percent or more (but less than 100%) may be used. Introduction of aqueous hydroxide may be carried out in about one or more stages.

The hydroxide and feedstock will be reacted at a temperature of from about 380° C. (716° F.) to about 450° C. (842° F.), preferably the temperature will be between about 400° C. to 425° C. The reaction time is typically at least about 5 minutes to about 3 hours. Preferably the reaction time will be about 0.5 to 1.5 hours. Temperatures of at least about 380° C. are necessary to remove organically bound sulfur which exist as sulfides and thiophenes. Sulfur is not removed from such compounds by the prior art processes involving NaOH, because reaction temperatures are too low to affect such sulfur moieties. Preferably, reaction temperatures are maintained at or below about 425° C. for treatment times of less than 90 minutes to prevent excessive cracking reactions from occurring.

In a preferred embodiment of the invention, molecular hydrogen will be added to the aqueous hydroxide system. Such hydrogen addition aids in the removal of the initially formed organic sulfide salt ($RS^-Na^+$, wherein R is an organic group in the oil) resulting in enhanced selectivity to sulfur-free products. The pressure of $H_2$ added will be from about 50 psi (345 kPa) to about 700 psi (4825 kPa), preferably about 200 psi (1380 kPa) to about 500 psi (3450 kPa) (cold charge) of the initial feed charge. Alternatively, hydrogen donor solvents (e.g., tetralin) can be added as a source of hydrogen or to supplement molecular hydrogen.

Applicants believe that, by way of example, with respect to the sodium hydroxide treatment step a possible pathway of the process for desulfurizing benzo[b]thiophenes follows Scheme 1.

Scheme 1

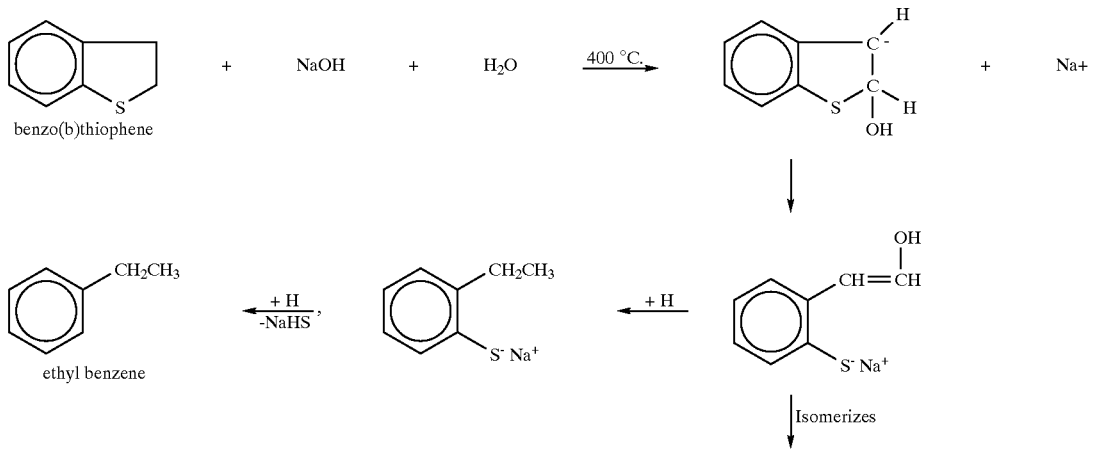

-continued

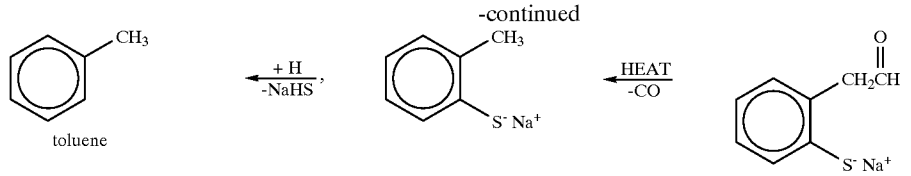

$$NaHS \xrightarrow{NaOH} Na_2S + H_2O$$

Thus, hydrogen addition can be utilized to selectively form ethylbenzene if desired. Likewise, heat can be utilized to selectively produce toluene from the isomerized sodium mercaptophenyl acetaldehyde.

Once the sodium hydroxide pretreatment step to produce a partially desulfurized product oil is carried out, the sodium sulfide generated can be used in one of several ways. One embodiment, exemplified in FIG. 3, involves contacting the demetallated partially desulfurized product oil in a second step with sodium metal, in the presence of hydrogen, to produce a final product oil having decreased sulfur content and $Na_2S$. The resultant sodium sulfide oil dispersion is treated with a controlled amount of water to facilitate recovery of $Na_2S$ from the oil. At least a portion of the hydrated $Na_2S$ so recovered can be recycled to treat additional heavy oil starting feed. Typically, sodium metal is electrolytically regenerated from the sodium sulfide hydrate after drying and after treatment with sulfur to form the feed for electrolysis, $Na_2S_4$. The process for sodium regeneration and sulfur recovery is described in U.S. Pat. No. 3,785,965, 3,787,315, 3,788,978, 3,791,966, 3,796,559, 4,076,613, and 4,003,824 incorporated herein by reference. Two other optional pathways involve using the $Na_2S$ from the initial sodium hydroxide treatment to regenerate NaOH for recycle to treat fresh starting feed. As exemplified in FIG. 1, the aqueous $Na_2S$ stream can be heated in the presence of a transition metal for a time and at a temperature sufficient to form a metal sulfide, sodium hydroxide and molecular hydrogen. Alternatively, as exemplified in FIG. 2, the aqueous sodium sulfide can be treated by steam stripping (i.e., in the presence of water) to generate a stream of sodium hydroxide and an effluent stream of hydrogen sulfide.

When sodium hydroxide is regenerated via the transition metal route, the metals are reacted with the sodium sulfide at a temperature of about 380° C. to about 425° C., preferably about 400° C. to about 425° C. The reaction typically will be carried out for at about 400° C. to about 425° C. for treatment times between 30 and 80 minutes.

The NaOH pretreatment step not only removes organically bound sulfur from existing as mercaptans, sulfides and thiophenes the feedstocks but advantageously also removes the metals vanadium, nickel and iron, and heteroatoms (nitrogen and oxygen). This step is capable of removing up to 50 percent or more of the organically bound sulfur from the feedstock. In addition, significant conversion of these organically bound sulfur containing heavy oils to lighter materials is evidenced by observed reductions in average molecular weight, micro concarbon residue (MCR) contents, 975° F. and higher boiling fractions, asphaltene contents, density and viscosity. Whereas, treatments without sodium hydroxide present generate more gas and solids (less oil) and increase overall MCR values.

Applicants believe that the chemical pathway for the foregoing step, where for example iron has been chosen as the transition metal, follows the equation below.

$$2Na_2S+4H_2O+Fe^{\circ} \rightarrow FeS_2+4NaOH+2H_2$$

The metals which can be utilized to desulfurize aqueous sodium sulfide include iron, cobalt or other effective transition metals, and mixtures thereof. The greater the surface area of the metal, the greater the conversion and selectivity to NaOH. Therefore, the metal will preferably have a particle size of 1200 to about 38 microns preferably 150 to about 50 microns. Most preferably, metal powder will be utilized in the instant invention. The stoichiometry dictates that at least 1 mole of iron, for example, is used for every 2 moles of sodium sulfide. When steam stripping is used to regenerate the sodium hydroxide, the reaction can be carried out at temperatures of about 150° C. to about 300° C., for reaction times sufficient to regenerate the NaOH and remove sulfur as hydrogen sulfide.

Thus, the regenerated sodium hydroxide upon recycle can be utilized for removing organically bound sulfur from fresh feedstock.

If sodium sulfide from the sodium metal desulfurization step plus water is chosen to generate the sodium hydroxide, the reaction is carried out at temperatures of about 380° C. to about 450° C., reaction times are about 30 minutes to about 90 minutes.

The organically bound sulfur decreased feedstock (partially desulfurized product oil) is separated and treated in a further step as follows. The partially desulfurized feed (product oil from the NaOH treatment step) is then contacted with Na metal under desulfurization conditions. Typically, "desulfurization conditions" include carrying out the Na metal treatment by contacting the organically bound sulfur containing feedstock (in the form of the partially desulfurized product oil) with sodium metal, under essentially anhydrous conditions, in the essential absence of oxygen at a temperature of from about 340° C. to about 450° C. and a hydrogen pressure of at least about 50 psi (345 kPa) to essentially completely desulfurize the feedstock.

The advantage of the integrated process of the present invention is that it can be used to reduce sodium requirements. About 30 to 50% less sodium metal is typically required for the essentially complete (to less than 0.2 wt % sulfur) removal of organically bound, particularly thiophenic sulfur and, as such, less electrochemical regeneration of sodium metal by this more costly step will be required. The process can remove as much as 50% of the organically bound sulfur in the first step and up to essentially all of the remaining organically bound sulfur in the second step. Viscosity and density reductions in the product oil are seen in both steps of the process.

The heavy oil feedstocks (organically bound sulfur containing feedstocks) which can be desulfurized in accordance with the present invention include any feedstock containing organically bound sulfur which exist as sulfides and/or thiophenes (i.e. sulfidic and/or thiophenic moieties) such as in bitumen from tar sands, heavy crude oils, refinery products with higher sulfur levels and petroleum resid.

Figure 2:
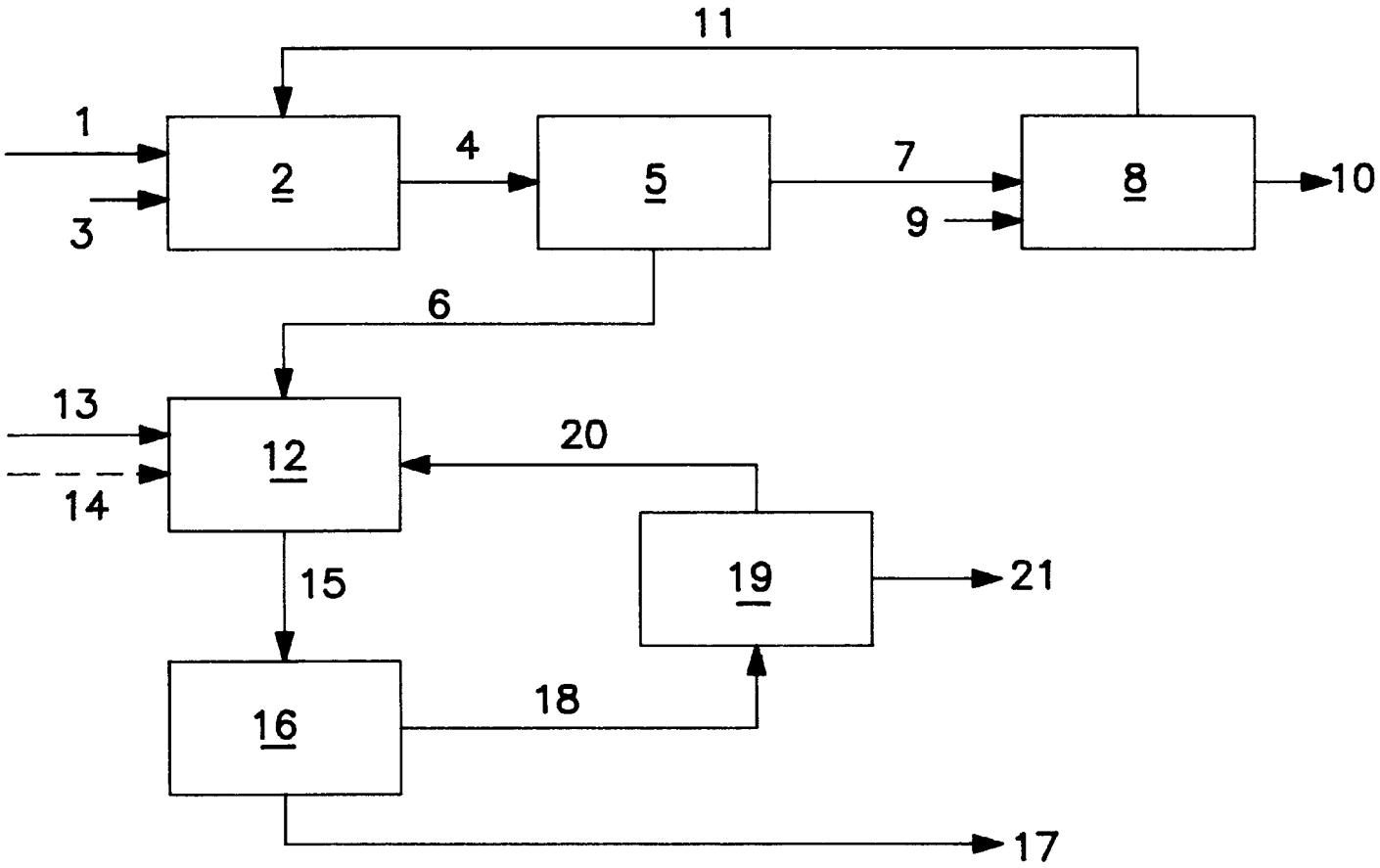
FIG. 2 describes an embodiment of the process using regeneration via steam stripping to regenerate sodium hydroxide from sodium sulfide salts in a combination process using sodium hydroxide as a pretreatment to sodium metal desulfurization of heavy oil feed.

The embodiments described in FIGS. 1 and 2, respectively, demonstrate the use of a transition metal solution and steam stripping, respectively, for in-situ regeneration of NaOH. Both embodiments also demonstrate the use of Na metal regeneration and recycle to decrease the need for addition of ex-situ fresh Na metal.

FIG. 1 describes a non-limiting embodiment of the present invention using NaOH regeneration via transition metal exchange. Therein a feed stream, 1, containing heavy oil (e.g., bitumen) and water is added to a first reaction zone, 2, wherein it is reacted with a second stream, 3, containing NaOH and $H_2$, from which an effluent stream, 4, containing partially desulfurized heavy oil, $Na_2S$ and water, is produced and passed to a first separation zone, 5, from which the partially desulfurized product oil, 6, is recovered and from which a spent reagent stream, 7, containing $Na_2S$ and water is recovered and fed along with $H_2$ to a sodium hydroxide (caustic) regenerator, 8, in the presence of a transition metal, 9, to generate an effluent stream, 10, containing transition metal sulfide and impurities such as Ni, V, and a recycle stream 11, containing NaOH and $H_2$, which is recycled to the first reaction zone for contact with bitumen. Dewatered product oil, 6, is passed to a second reaction zone, 12, wherein it is contacted with hydrogen stream, 13, and metallic sodium, stream, 14, to produce a second effluent stream, 15, which is fed to a second separation zone, 16, which produces a final, essentially sulfur-free oil, 17, which is recovered, and a sodium sulfide salt stream, 18, which after suitable treatment to convert said sodium sulfide salt to a sodium polysulfide ($Na_2S_x$, where in X=at least 3) is fed to a second regeneration zone, 19, which constitutes an electrolytic cell wherein anode and cathode compartments are separated by a sodium ion conducting membrane. Regenerated sodium metal, 20, is recycled to reaction zone 12 and a sulfur enriched polysulfide ($Na_2S_x$, wherein x is typically between 4 and 5), 21, is fed to a pyrolysis zone (not shown) to recover an amount of sulfur equivalent to that removed from the oil in zone 12, and a sulfur-depleted polysulfide that is returned to regeneration zone 19. If metal impurities remain in the oil that is fed to reaction zone 12, they will be removed and recovered as part of the sodium sulfide salt stream, 18. Thus, in order to control buildup of such impurities in the electrolytic cell feed, it may be necessary to remove a small purge from stream 18, which purge is reworked to recover metals and sodium sulfide.

FIG. 2 describes a non-limiting embodiment of the present invention using NaOH regeneration via steam stripping. Therein a feed stream, 1, containing heavy oil and water is added to a first reaction zone, 2, wherein it is reacted with a second stream, 3, containing NaOH and $H_2$, from which an effluent stream, 4, containing partially desulfurized heavy oil, $Na_2S$, and water is produced and passed to a first separation zone, 5, from which the partially desulfurized product oil, 6, is recovered and from which a spent reagent stream, 7, containing $Na_2S$ and water is recovered and fed to a sodium hydroxide (caustic) regenerator, 8, wherein the solution, under pressure, is stripped with steam, 9, or with hydrogen to generate an effluent stream, 10, containing hydrogen sulfide and a recycle stream, 11, containing NaOH and water which is recycled along with hydrogen to the first reaction zone for contact with heavy oil. The dewatered product oil, 6, produced by the separator, 5, is passed to a second reaction zone, 12, wherein it is contacted with a $H_2$ stream, 13, and Na metal, 14, to produce a second effluent stream, 15, which is fed to a second separator, 16, which produces a final essentially sulfur-free product oil, 17, which is recovered, and a Na sulfide salt stream, 18, which is further processed to recover metallic sodium and sulfur in accordance with the description given for the process of FIG. 1.

Figure 3:
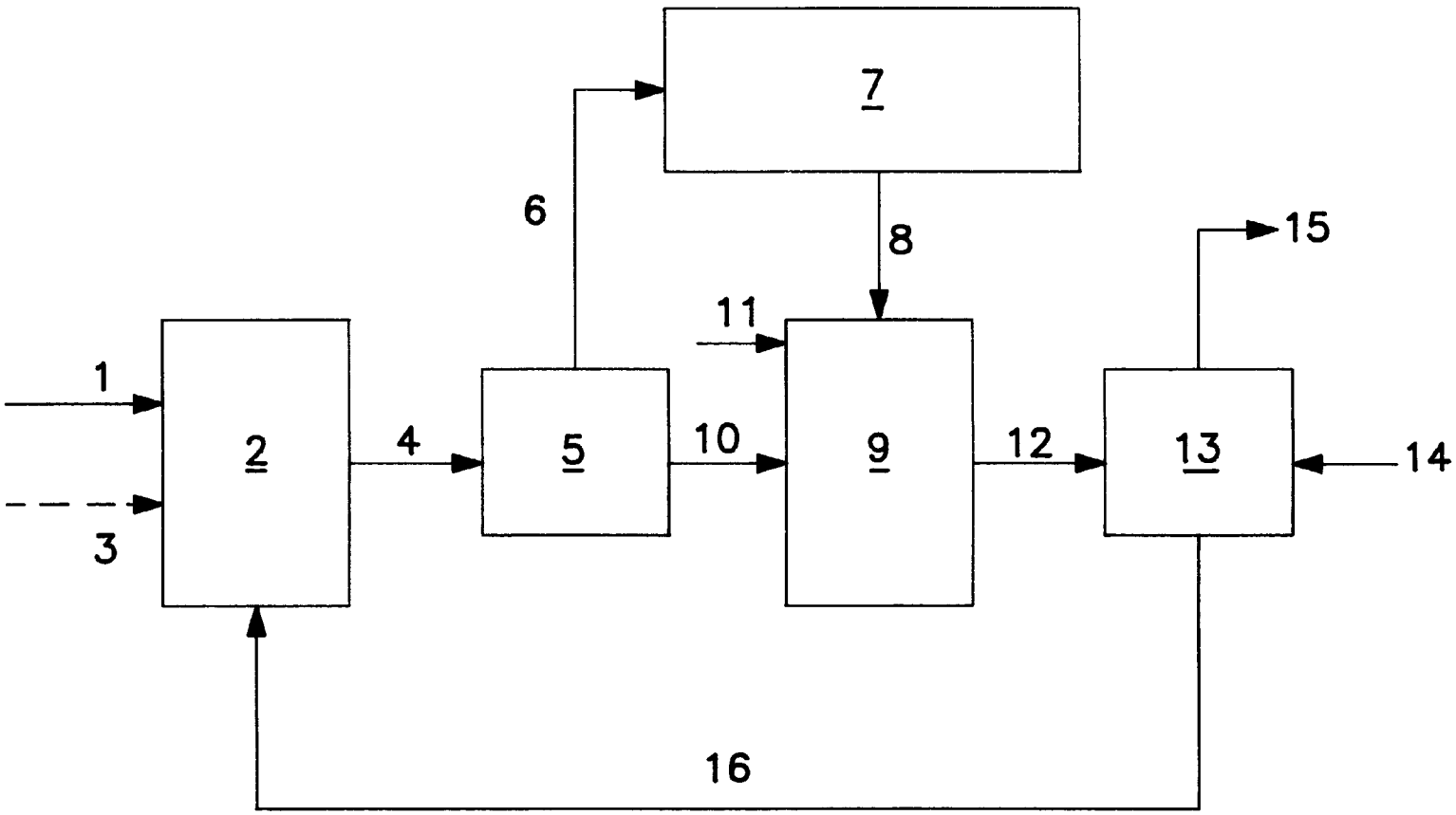
FIG. 3 describes an embodiment of the process wherein a portion of the sodium sulfide generated from the sodium metal desulfurization is converted to sodium hydroxide and sodium hydrosulfide (with water) for a pretreatment step to partially desulfurize the heavy oil feed.

FIG. 3 describes a non-limiting embodiment of the present invention using a portion of the by-product, $Na_2S$, from the sodium metal treatment step to regenerate NaOH. This is to decrease demand for addition of fresh, ex-situ, sodium metal. The process takes advantage of the equilibrium between $Na_2S+H_2O$ and NaSH+NaOH. Therein a feedstream containing heavy oil (e.g., bitumen) and a controlled amount of water, 1, is added to a first reaction zone, 2, wherein it is reacted with a second stream containing $H_2$, 3, and sodium sulfide, 16, to produce an effluent stream containing partially desulfurized heavy oil and sodium salts, $Na_2S$ and NaHS, 4, which is passed to a separation zone, 5, wherein sodium salts, 6, are separated and recovered (e.g., filtration or by settling and draw off, from the partially desulfurized heavy oil). The sodium salts, 6, are fed to sodium regenerator, 7, to produce regenerated sodium metal, 8, which is passed to a second reaction zone, 9, and the partially desulfurized, dewatered heavy oil, 10, from the separation zone, 5, is passed to the second reaction zone, 9, wherein it is reacted with added hydrogen, 11, and sodium metal, 8, from the sodium regenerator, 7, to produce a final essentially sulfur-free product oil and $Na_2S$ effluent mixture, 12, which is passed to a second separator, 13, wherein the final essentially desulfurized product oil, 15, is recovered and the $Na_2S$ is treated with water, 14, to generate a recycle stream, 16, containing $Na_2S$ and water, for recycle to reaction zone 2.

The following examples are for illustration and are not meant to be limiting.

The following examples illustrate the effectiveness of aqueous hydroxide systems in removing sulfur from model compounds. The compounds used are representative of the different sulfur moieties found in Alberta tar sands, bitumen and heavy oils. The experimental conditions include a temperature range of from about 400° C. to about 425° C. for 30 to 120 minutes. After the organic sodium sulfide salt is formed, the sulfur is removed from the structure as sodium hydrosulfide (which reacts with another sodium hydroxide to generate sodium sulfide and water). Additional experiments showed that the addition of a hydrogen donor solvent (e.g., tetralin) or molecular hydrogen to the aqueous base system aids in the removal of the initially formed salt as sodium hydrosulfide. Identical treatment of model compounds without base showed no reactivity. These controls were carried out neat (pyrolysis) and in the presence of water at 400° C. for two hours. All results are shown in Table 1.

EXAMPLE 1

Aqueous Hydroxide Treatment

Autoclave experiments on heavy oils (bitumen) from both the Athabasca and the Cold Lake regions of Alberta, Canada, demonstrate the ability of aqueous base treatments in the preferred temperature range (400 to 425° C.) to remove over 50% of the organic sulfur in the oils (Table 2). The sulfur in these oils are known to exist primarily as sulfides (27–30%) and thiophenes (70–73%). The greater than 50% desulfurization indicates that thiophenic sulfur moieties are affected by the treatment as well as the relatively weaker C—S bonds in certain sulfides (aryl-alkyl and dialkyl). Other beneficial effects of the treatment include reduction of the vanadium and iron to below detectable levels and almost 75% removal of the nickel. The levels of nitrogen are reduced as well as the contents of coke-precursor materials (heavy-end generation) as measured by MCR (Micro Carbon Residue) content. Additional evidence of reduced heavy-end materials exists in the asphaltene contents (measured as n-heptane insoluble materials) and average molecular weight (MW). The density and viscosity of the treated oils are also significantly lower. The observed increase in atomic H/C ratio illustrates that hydrogen has been incorporated into the products, which is expected based on the chemistry shown from the model compound studies.

In the absence of base, treatments carried out with only hydrogen added and also with only water and hydrogen added show that only 26% of the native sulfur is removed under the same temperature conditions (Table 3). The sulfur is removed as hydrogen sulfide gas produced from thermal cracking at these temperatures. The sulfur recovered from the aqueous sodium hydroxide treatments is recovered as sodium sulfide with no hydrogen sulfide generation.

Treatments carried out with aqueous base at lower temperatures (350° C.) show that only 14.2% of the sulfur is removed (S/C ratio of 0.0193 from 0.0225 on another Cold Lake bitumen sample). At 400° C., the same sample treated under the same conditions was reduced only by 13.3% in water only and by 35.1% in the presence of aqueous sodium hydroxide.

TABLE 1

Aqueous Sodium Hydroxide Treatments of Benzo[b]thiophene(B[b]T) 1.0 g B[b]T, 6.0 g Aqueous NaOH)

| | Toluene | Ethyl Benzene | % Conversion[1] | % Selectivity[2] | % Heavy Ends[3] |
|---|---|---|---|---|---|
| 400° C./2 Hrs. | | | | | |
| 10% Aq. NaOH | 9.9 | 5.1 | 89 3 | 23.2 | 4.1 |
| 10% Aq. NaOH + tetralin | 28 2 | 14.6 | 88.8 | 52.5 | 3.0 |
| 10% Aq. NaOH + $H_2$ (700 psig cold) | 39.1 | 57.5 | 99.8 | 98.6 | 0.3 |
| 400° C./1 Hr. (no hydrogen) | | | | | |
| 10% Aq. NaOH (1.5 eqs.) | 4.0 | 1.8 | 89.1 | 10.9 | 2.4 |
| 10% Aq. NaOH (2.7 eqs.) | 57.0 | 19.0 | 82.0 | 95.1 | 0.3 |

Note: Benzo[b]thiophene showed no reaction when treated in neutral water and no reaction under neat (pyrolysis) conditions.

1) % Conversion = 100%–% benzo[b]thiophene present.

2) % Selectivity = % of products as S-free products.

3) % Heavy Ends = % products greater in molecular weight than benzo[b] thiophene.

Note: 10% aqueous NaOH is 90% $H_2O$ based on alkali metal hydroxide.

TABLE 2

Autoclave Treatments of Alberta Bitumens With Aqueous Sodium Hydroxide* for 90 minutes, 500 psig (3447 kPa) Hydrogen, cold charge

| | Athabasca (1:4 water:bitumen) | | Cold Lake (1:5 water:bitumen) | |
|---|---|---|---|---|
| | Untreated | Treated | Untreated | Treated |
| P at 400° C. in psig (kPa) | — | 1680 (11,582) | — | 1758 (12,120) |
| P at 425° C. in psig (kPa) | — | 1834 (12,644) | — | 2030 (13,995) |
| S/C Ratio | 0.0240 | 0.0108 | 0.0184 | 0.00917 |
| % Desulfurization | — | 55.0 | — | 50.2 |
| H/C Ratio | 1.441 | 1.506 | 1.536 | 1.578 |
| N/C Ratio | 0.00528 | 0.00337 | 0.00400 | 0.00321 |
| % Denitrogenation | — | 36.2 | — | 19.8 |
| Metals (ppm) | | | | |
| Vanadium | 216 | <10 | 160 | <12.5 |
| Nickel | 88 | 25 | 62 | 15 |
| Iron | 855 | 0.7 | <9.5 | <12.5 |
| % MCR | 14.0 | 6.9 | 12.7 | 4.9 |
| % Asphaltenes | 14.2 | 5.3 | 11.2 | 2.1 |
| Molecular Weight | 607 | 268 | 473 | 257 |
| Density (22° C.) | 1.026 | 0.936 | — | — |
| Viscosity (25°) | >500,000 | 10.5 | 468 | 7.9 |

*1.8 fold molar excess of NaOH used.

**66.4 g Bitumen, 15.0 g $H_2O$, 20.0 g NaOH

***70.5 g Bitumen, 15.0 g $H_2O$, 20.0 g NaOH

Note: 20.0 g NaOH is 43% $H_2O$ based on the alkali metal hydroxide.

TABLE 3

| Autoclave Treatments of Athabasca Bitumen at 425° C. for 90 minutes 500 psig (3447 kPa) Hydrogen, cold charge | | | | |
|---|---|---|---|---|
| | Untreated | Hydrogen (78.40 g Bitumen) | Water/Hydrogen (69.2 g Bitumen, 25.0 g Hydrogen) | NaOH*/Water/Hydrogen (66.4 g Bitumen, 15.0 g $H_2O$**, 20.0 g NaOH) |
| % Gas Make | — | 3.8 | 4.6 | 1.6 |
| % Solids Formed | — | 18.1 | 22.1 | 6.5 |
| Net Effects (including solids) | | | | |
| % MCR | 14.0 | 18.5 | 14.9 | 10.1 |
| % Desulfurization | — | 26.2 | 25.5 | 49.1 |

*1.7 fold molar excess of NaOH used
**43% water, based on wt. of NaOH present.

Benzo[b]thiophene was subjected to a series of treatments with aqueous sodium sulfide. This was in an effort to generate NaOH and hydrogen in-situ to then do the NaOH desulfurization observed to occur via the pathways shown in Scheme 1. Those systems showed that in the presence of added molecular hydrogen or hydrogen donor solvents (e.g., tetralin), there was more of an abundance of ethyl benzene over toluene due to the ability of the hydrogen to saturate the double bond of the intermediate vinyl alcohol. Without hydrogen present, more isomerization occurs to the aldehyde, which decarbonylates to yield toluene from benzo [b]thiophene.

Table 4 shows the data obtained for these reactions carried out without external hydrogen added (400° C. for 60 minutes). The data show that the addition of iron or cobalt increases the level of desulfurization and the selectivity to ethyl benzene. This is evidence that NaOH is generated as well as molecular hydrogen. Both conversion and selectivity also appear to be a function of the surface area of the metal, in that the more exposed the metal surface, the more reaction to yield NaOH and hydrogen.

Table 5 provides some additional data using NaOH to treat benzo[b]thiophene. The addition of iron powder increased the levels of both conversion and selectivity indicating that some regeneration of the NaOH occurred in-situ to further desulfurize the compound. The accompanying increases in ethyl benzene to toluene ratio indicates that some hydrogen was present as well. Comparative data is provided for how effective the desulfurization can be when external hydrogen is added.

TABLE 4

| Aqueous Sodium Sulfide Treatments of Benzo[b]thiophene (B[b]T) (400° C., 1 hr., 0.4 g B[b]T, 3.0 g 10% Aqueous $Na_2S$ (90% water based on $Na_2S$), 0.2 g Metal) | | | | |
|---|---|---|---|---|
| | Additive | | | |
| Percent | None | Fe filings | Fe powder | Co powder |
| Benzo[b]thiophene | 68.7 | 58.9 | 43.3 | 14.7 |
| Toluene | 3.8 | 6.1 | 5.3 | 4.8 |
| Ethyl benzene | 5.5 | 13.9 | 25.7 | 7.2 |
| Phenol | 0.2 | | 0.2 | 0.5 |
| o-ethyl phenol | 0.2 | | 0.1 | 0.6 |
| o-ethyl thiophenol, sodium salt | 5.9 | 4.1 | 3.2 | 24.1 |
| o-ethyl thiophenol, sodium salt | 11.1 | 14.5 | 18.8 | 44.8 |
| "Heavy Ends" (products higher in MW than B[b]T) | 1.7 | 1.1 | 1.7 | 1.9 |

TABLE 4-continued

| Aqueous Sodium Sulfide Treatments of Benzo[b]thiophene (B[b]T) (400° C., 1 hr., 0.4 g B[b]T, 3.0 g 10% Aqueous $Na_2S$ (90% water based on $Na_2S$), 0.2 g Metal) | | | | |
|---|---|---|---|---|
| | Additive | | | |
| Percent | None | Fe filings | Fe powder | Co powder |
| Conversion | 31.3 | 41.1 | 56.7 | 85.3 |
| Selectivity | 31.6 | 48.9 | 55.4 | 15.4 |

TABLE 5

| Aqueous Sodium Hydroxide Treatments of Benzo[b]thiophene (B[b]T) (400° C., 1.0 hr., 3.0 g 10% Aqueous NaOH (90% water based on wt. of NaOH), 0.4 g (B[b]T) | | | |
|---|---|---|---|
| | Additive | | |
| Percent | None | Fe* powder | Hydrogen** |
| Benzo[b]thiophene | 10.9 | 5.9 | 0.2 |
| Toluene | 4.0 | 7.7 | 39.1 |
| Ethyl benzene | 1.8 | 7.1 | 57.5 |
| Phenol | 2.2 | 0.5 | <0.1 |
| o-ethyl phenol | 1.7 | 0.9 | 0.4 |
| o-methyl thiophenol, sodium salt | 47.7 | 33.3 | <0.1 |
| o-ethyl thiophenol, sodium salt | 27.4 | 42.0 | <0.1 |
| "Heavy Ends" (products higher in MW than B[b]T) | 2.4 | 2.0 | 0.3 |
| Conversion | 89.1 | 94.1 | 99.8 |
| Selectivity | 10.9 | 17.2 | 98.6 |

*0.2 g Fe powder used
**700 psig $H_2$ (cold charge)

Autoclave experiments on heavy oils (bitumen) from both the Athabasca and the Cold Lake regions of Alberta, Canada, demonstrate the ability of sodium metal in the preferred temperature range of 260 to 400° C. with the preferred hydrogen pressure of 100 to 700 psi (690 to 4825 kPa)—with a more preferred range of 200 to 300 psi (1380 to 2070 kPa) and for the preferred amount of treatment time (2 to 90 minutes) to remove 93 to 98% of the organic sulfur from the oils (Table 6). The low levels of sulfur in the product oils indicate that all of the sulfur moieties, particularly thiophenic and sulfidic, are affected by the treatment. These data also indicate that the sodium metal treatment would be as effective in removing sulfur from the same bitumens that were pretreated to contain even lower levels of the same sulfur types, as in the aqueous base pretreated bitumens that contain as little as 45% of the native sulfur that existed as thiophenes and sulfides. Other beneficial effects of the sodium metal treatment step include reduction of the metals (nickel and vanadium) by 50 to 62% and significant reductions in specific gravity and viscosity (Table 6).

TABLE 6

Autoclave Treatments of Alberta Bitumens with Sodium Metal

| | Athabasca Bitumen Run Temp. 356° C. with 300 psi (2070 kPa) $H_2$ charge (cold) 250 g bitumen, 26.88 g Na Treat Time = 5 mins. at run temp. | | Cold Lake Bitumen Run Temp. 340° C. with 190 psi (1310 kPa) $H_2$ charge (cold) 321.5 g bitumen, 31.11 g Na Treat Time = 18 mins. at run temp. | |
|---|---|---|---|---|
| | Untreated | Treated | Untreated | Treated |
| Wt % Sulfur | 5.61 | 0.14 | 4.95 | 0.36 |
| % Desulfurization | — | 97.5 | — | 92.7 |
| Specific Gravity (15° C.) | 1.024 | 0.958 | 1.0033 | 0.964 |
| Viscosity (cP, 20° C.) | 360,000 | 2,280 | 85,800 | 4,090 |
| Metals (ppm) | | | | |
| Nickel | 80 | 12 | 80 | 31 |
| Vanadium | 213 | 99 | 205 | 112 |

Table 7 shows the results treating Athabasca bitumen under aqueous base conditions and then treating with metallic sodium.

TABLE 7

| | Athabasca Bitumen | | |
|---|---|---|---|
| | Untreated | After Aq. NaOH | After Na |
| Wt % Sulfur | 5.65 | 3.11 | 0.38 |
| Metals (ppm) | | | |
| Iron | 856 | 0 | 0 |
| Nickel | 88 | 38.9 | 6.5 |
| Vanadium | 216 | 12.6 | 0 |
| Viscosity (cP, 20° C.) | >600,000 | — | 220 |
| Density (g/cc) | 1.026 | — | 0.909 |

The total desulfurization was 93+% after both treatments. The total remove levels of iron, nickel and vanadium was 100%, 93% and 100%, respectively.

What is claimed is:

1. A continuous process for removal of organically bound sulfur and decreasing the heteroatoms and metals content, and viscosity, density and molecular weight of the heavy oil, comprising the steps of:

(a) contacting a heavy oil containing organically bound sulfur heteroatoms and metals wherein the organically bound sulfur is selected from the group consisting of mercaptans, thiophenes and sulfides, the metals are selected from the group consisting of iron, nickel, and vanadium and mixtures thereof and the heteroatoms are selected from the group consisting of oxygen and nitrogen, with a first portion of aqueous non-molten sodium hydroxide containing at least 30% water based on the amount of sodium hydroxide, hydrogen at a temperature of from about 380° C. to 450° C. for a time sufficient to partially desulfurize the heavy oil and form sodium sulfide;

(b) contacting said sodium sulfide of step (a) with steam under steam stripping conditions to produce sodium hydroxide and hydrogen sulfide;

(c) recirculating said sodium hydroxide of step (b) to step (a) and recovering the hydrogen sulfide;

(d) contacting the partially desulfurized heavy oil of step (a) with sodium metal under desulfurizing conditions to produce an essentially sulfur-free product oil having a reduced heteroatom and metals content, reduced viscosity, density and molecular weight, and sodium sulfide.

2. The method of claim 1 wherein molecular hydrogen is added to step (a).

3. The method of claim 1 wherein the concentration of aqueous hydroxide to heavy oil is from about 5 wt % to about 60 wt %.

4. The method of claim 1 wherein step (b) is conducted at a temperature of about 380° C. to about 450° C. for about 0.5 to about 1.5 hours.

5. The method of claim 1 wherein at least about 50% of the sulfur is removed in the partially desulfurized heavy oil of step (a).

6. The method of claim 1 wherein the aqueous sodium hydroxide contains at least 40% water based on the amount of sodium hydroxide.

7. The method of claim 1 wherein the aqueous sodium hydroxide contains at least 90% water based on the amount of sodium hydroxide.

* * * * *